US011584409B2

(12) United States Patent
Fletcher et al.

(10) Patent No.: US 11,584,409 B2
(45) Date of Patent: Feb. 21, 2023

(54) RAILROAD COLOR LIGHT SIGNALS INCLUDING WIND REDUCTION ELEMENTS

(71) Applicant: Siemens Mobility, Inc., New York, NY (US)

(72) Inventors: Nathan Fletcher, Louisville, KY (US); Zhenzhong Long, Louisville (KY)

(73) Assignee: Siemens Mobility, Inc., New York, NY (US)

( * ) Notice: Subject to any disclaimer, the term of this patent is extended or adjusted under 35 U.S.C. 154(b) by 0 days.

(21) Appl. No.: 17/401,780

(22) Filed: Aug. 13, 2021

(65) Prior Publication Data

US 2022/0063687 A1 Mar. 3, 2022

Related U.S. Application Data

(60) Provisional application No. 63/070,673, filed on Aug. 26, 2020.

(51) Int. Cl.
*B61L 5/18* (2006.01)

(52) U.S. Cl.
CPC ..... *B61L 5/1827* (2013.01); *B61L 2207/02* (2013.01)

(58) Field of Classification Search
CPC ..... B61L 5/1827
USPC ..... 246/473.3
See application file for complete search history.

(56) References Cited

U.S. PATENT DOCUMENTS

| | | | | |
|---|---|---|---|---|
| 4,654,629 | A * | 3/1987 | Bezos | B61L 15/02 340/815.45 |
| 11,422,555 | B2 * | 8/2022 | Kim | G05D 1/0088 |
| 11,423,527 | B2 * | 8/2022 | Krueger | G06N 20/00 |
| 2007/0290887 | A1 * | 12/2007 | Pleasanton | G08G 1/0955 340/908 |
| 2008/0150758 | A1 * | 6/2008 | Vallejo Sr. | G08G 1/095 340/907 |
| 2022/0063687 | A1 * | 3/2022 | Fletcher | B61L 5/1836 |

* cited by examiner

*Primary Examiner* — Bryon T Gyllstrom

(57) ABSTRACT

A railroad signal includes a mounting bracket and a signal head, the signal head being mounted to another structure by the mounting bracket, wherein the signal head includes a signal housing, a plurality of signal lights positioned in the signal housing, and a protection device for reducing or eliminating wind forces, the protection device comprising a snow shield and at least one wind guide element.

11 Claims, 8 Drawing Sheets

RAILROAD COLOR LIGHT SIGNALS INCLUDING WIND REDUCTION ELEMENTS

BACKGROUND

1. Field

Aspects of the present disclosure generally relate to railroad signals, for example crossing signals and wayside signals, such as railroad color light signals, including wind reduction elements.

2. Description of the Related Art

The railroad industry employs railroad signals, also known as wayside signals or simply signals, to inform train operators of various types of operational parameters. For example, colored wayside signal lights are often used to inform a train operator as to whether and how a train may enter a block of track associated with the wayside signal light. The status/color of wayside signal lamps is sometimes referred to in the art as signal aspect. One simple example is a three color system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Typically, a color light signal includes a snow shield and supports, a background, lenses, a signal housing, and a mounting bracket. A light source in the signal housing generates light that is emitted through one or more lenses and visible at a distance. Both the snow shield and the background block sunlight, from sides and back of the signal, so that the colored lights can be seen from a far distance.

The snow shield is mounted to the background which is fixed to the signal housing. The signal housing is bolted to the mounting bracket. The railroad signal is typically secured onto a pipe or another bracket, which is on a signal bridge, a signal cantilever, or a signal mast. The color light signals are high in the air, normally 10 feet to 40 feet above ground. Since a railroad signal can be positioned at any location or any direction along railroad lines, it may experience larger wind load(s) that may result in damage either on the signal itself or on its support structure.

SUMMARY

Briefly described, aspects of the present disclosure generally relate to a signal head and a railroad signal including wind reduction elements. One of ordinary skill in the art appreciates that such railroad signal heads and signals can be configured to be installed in different environments or locations where signals and signaling devices may be used. Further, it should be noted that the signals described herein may be configured as crossing signal, such as flashing light signal, wayside signal or other uses of signal lights that provide wayside status information include lights that indicate switch position, hazard detector status (e.g., broken rail detector, avalanche detector, bridge misalignment, grade crossing warning, etc.), search light mechanism position, among others. Furthermore, the signals as described herein may be configured as a road traffic signal or many other types of signals.

A first aspect of the present disclosure provides a signal head comprising a signal housing, a plurality of signal lights positioned in the signal housing, and a protection device for reducing or eliminating wind forces, the protection device comprising a snow shield, and at least one wind guide element.

A second aspect of the present disclosure provides a railroad signal comprising a mounting bracket and a signal head, the signal head being mounted to another structure by the mounting bracket, wherein the signal head comprises a signal housing, a plurality of signal lights positioned in the signal housing, and a protection device for reducing or eliminating wind forces, the protection device comprising a snow shield and at least one wind guide element.

DETAILED DESCRIPTION

To facilitate an understanding of embodiments, principles, and features of the present disclosure, they are explained hereinafter with reference to implementation in illustrative embodiments. In particular, they are described in the context of being a signal, for example a color light signal. Embodiments of the present disclosure, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
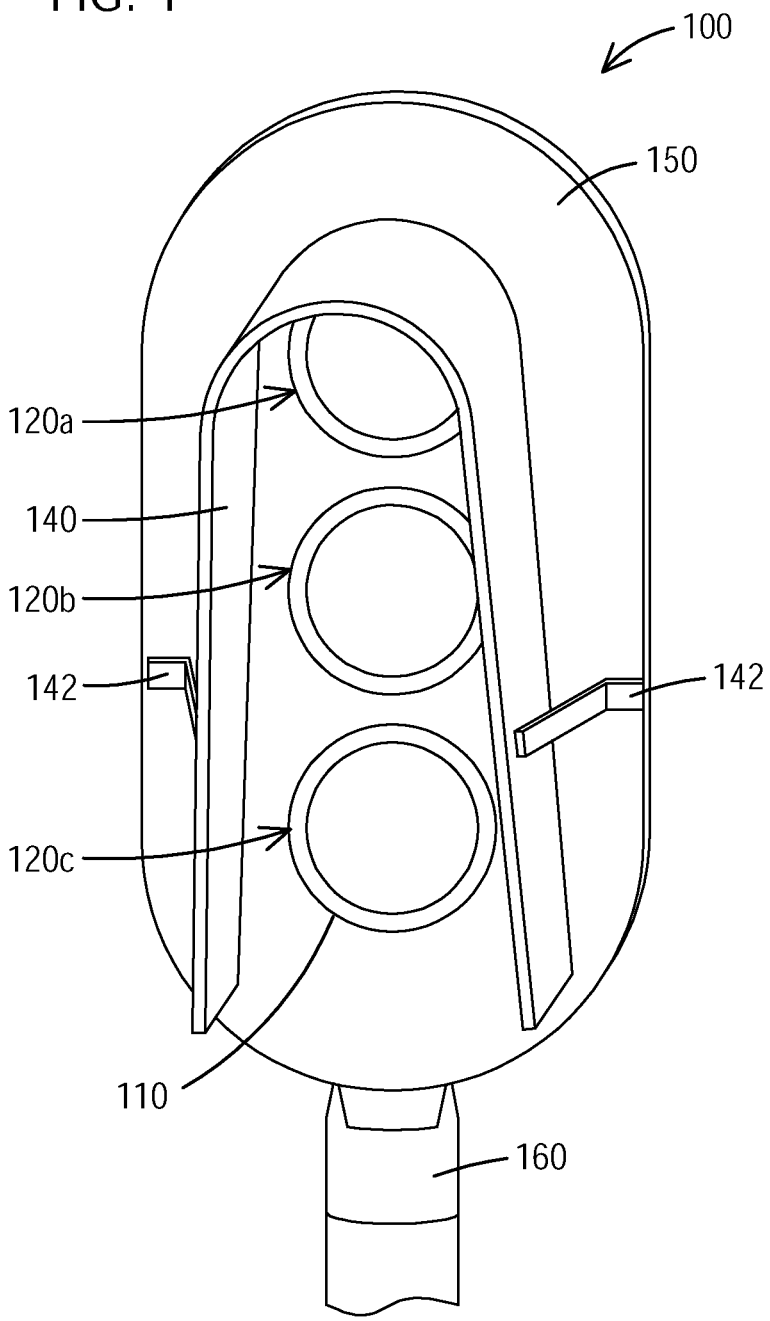
FIG. 1 and FIG. 2 illustrate different views of a known railroad signal.
Figure 2:
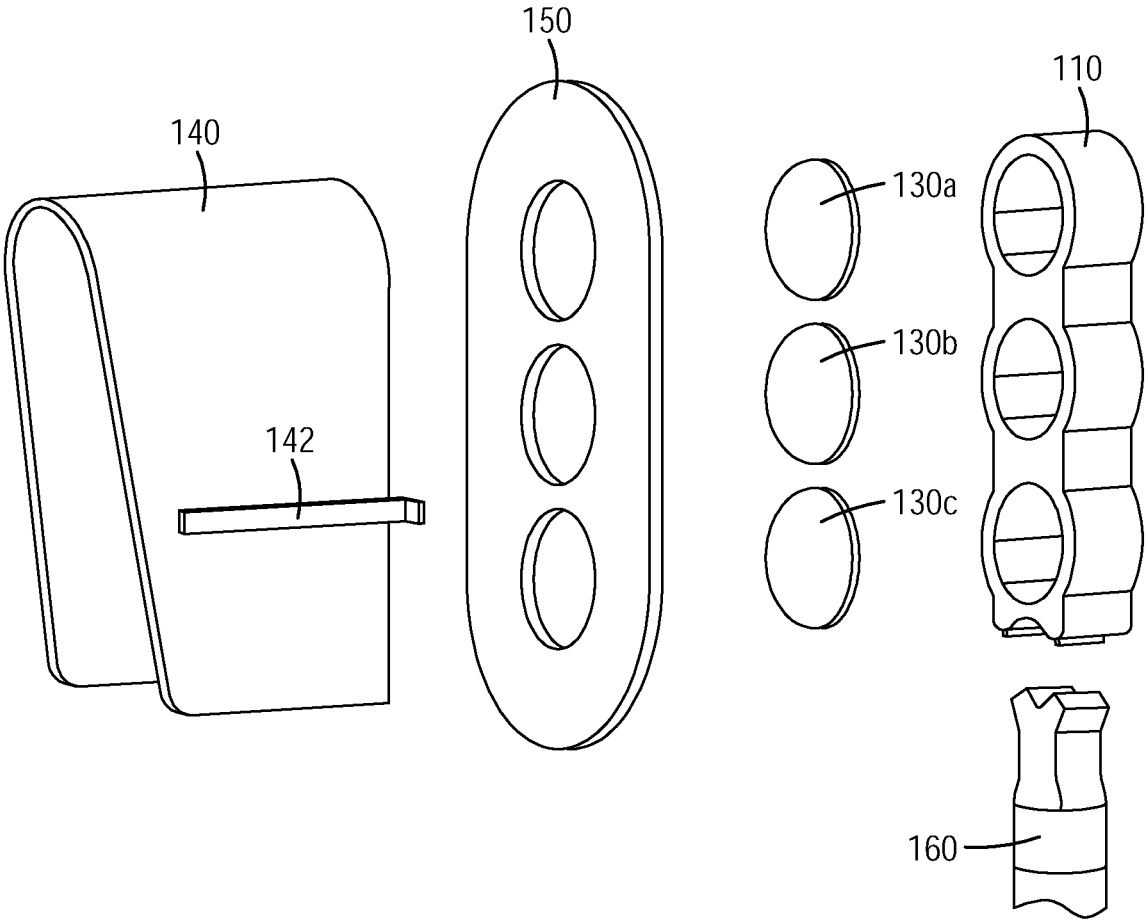

FIG. 1 and FIG. 2 illustrate a different views of a known railroad signal, specifically a color light signal. Signal head 100 comprises a signal housing 110, a plurality of signal lights 120*a*, 120*b*, 120*c* positioned in the signal housing 110 and a plurality of lenses 130*a*, 130*b*, 130*c* for focusing light output of the plurality of signal lights 120*a*, 120*b*, 120*c*. In our example, for each signal light a lens 130*a*, 130*b*, 130*c* is provided. An example is a three color system comprising for example a red, a yellow and a green light. The lights 120*a*, 120*b*, 120*c* can comprise LEDs and/or incandescent lighting.

Further, the signal head 100 includes a snow shield 140 and mounting and support elements 142. The snow shield 140 is mounted, using the mounting and support elements 142, to background support structure 150, wherein the background support structure 150 is fixed to the signal housing 110.

The plurality of lights 120*a*, 120*b*, 120*c* are light sources and emit light that is focused and go through the lenses 130*a*, 130*b*, 130*c* so that light(s) can be seen at a distance. Both the snow shield 140 and the background support structure 150 block sunlight from sides and back of the signal head 100, so that the generated colored lights can be seen from a far distance.

The signal housing 110 is mounted, for example bolted, to a mounting bracket 160 or type of structure for mounting the signal head 100 to a mast or post. Typically, the signal head 100 is secured onto a pipe or another bracket, which is on a signal bridge, a signal cantilever, or a signal mast.

Figure 3:
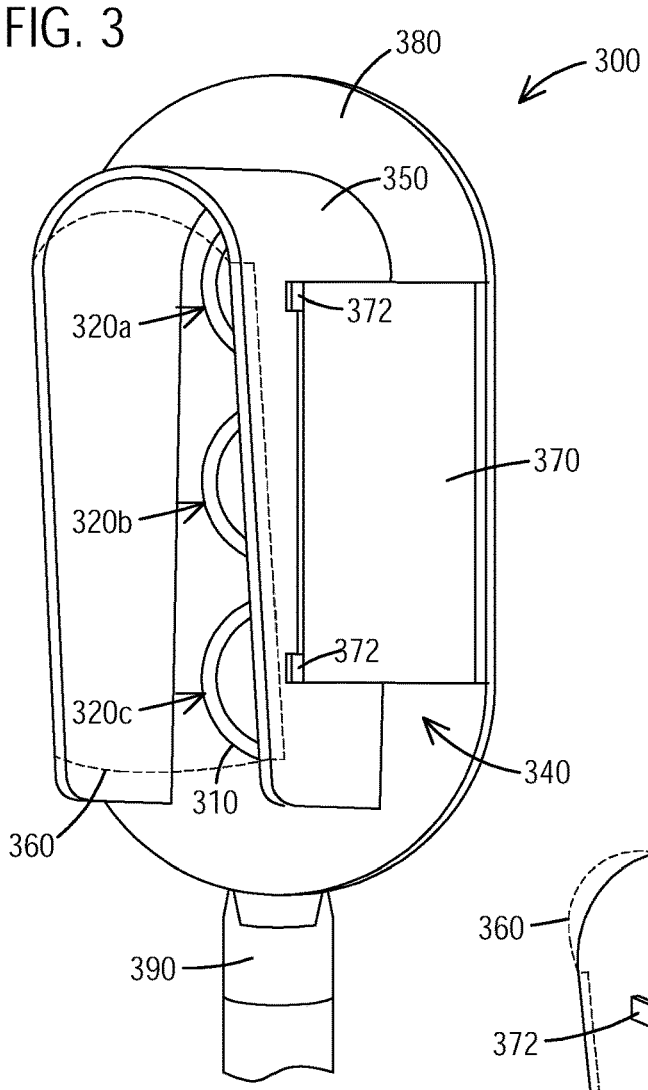
FIG. 3 illustrates a perspective angled front view of a first embodiment of a railroad signal in accordance with an exemplary embodiment of the present disclosure.

FIG. 3 illustrates a perspective angled front view of a first embodiment of a railroad signal in accordance with an exemplary embodiment of the present disclosure.

As noted, color light signals are high in the air, normally 10 feet to 40 feet above ground. Depending on the location of the signal, the signal may experience large wind loads which may result in damage either on the signal itself or on its support structure.

With respect to known railroad signals such as shown for example in FIG. 1 and FIG. 2, a primary air flow simulation, using for example simulation software, shows that 1) a large portion of the snow shield enclosed area has a higher pressure; 2) the rear surface is under a vacuum condition; and 3) the air is circled back on the rear of the signal when a normal front wind passes through it. When front winds reach the snow shield enclosed area, the stationary signal turns the normal air moment into a down moment, which results in a higher pressure. The circling air on the rear is a reason of the vacuum at this area. The pressure difference between the front and the rear, or the pressure drag, results in a wind force on the signal.

In an exemplary embodiment of the present disclosure, a signal with signal head 300 comprises signal housing 310, a plurality of signal lights 320*a*, 320*b*, 320*c*, positioned in the signal housing 310, and a protection device 340.

The protection device 340 as described herein generally comprises one or more components that protect the signal, in particular eliminate or reduce wind loads in connection with the signal, specifically with respect to the signal head 300. The protection device 340 reduces or eliminates wind loads and thus reduces or eliminates damage on the signal, for example by adding wind path(s) or features that allow air to flow around the signal head 300 ('external' wind path) or that allow air to enter and/or exit the signal head 300 ('internal' wind path). Further, the protection device 340 with its components is configured to block surrounding light from sides and back of the signal head 300 to ensure that the traffic lights are well visible when in operation.

Figure 4:
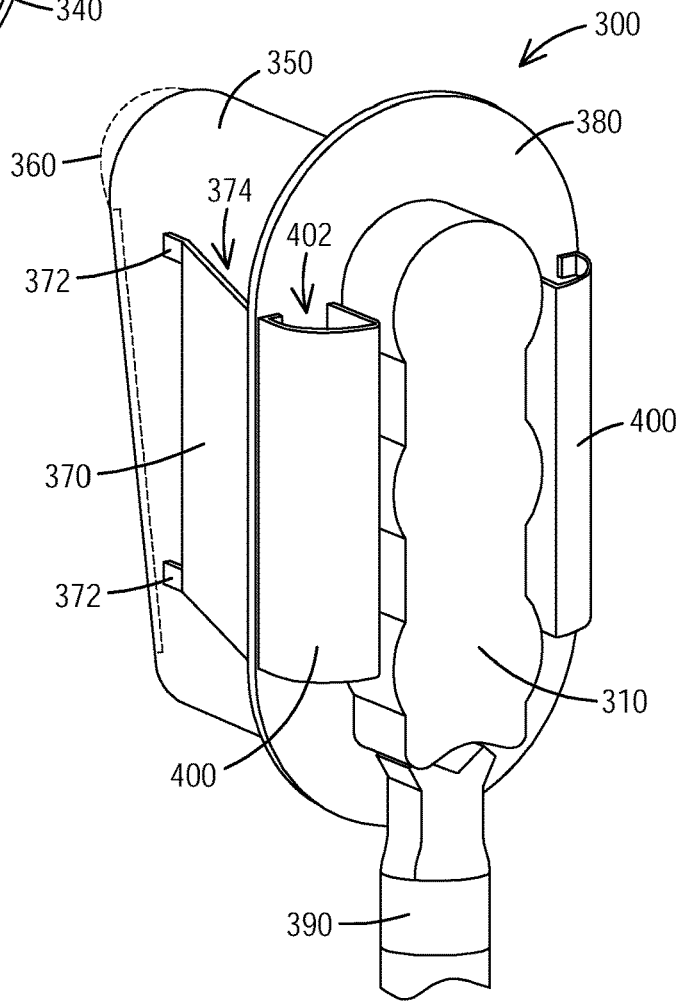
FIG. 4 illustrates a perspective angled rear view of the first embodiment of a railroad signal in accordance with an exemplary embodiment of the present disclosure.

The protection device 340 comprises a snow shield 350, and at least one wind guide element or feature, for example transparent wind guide 360 and/or front side wind guide(s) 370. The first embodiment described in connection with FIG. 3 and FIG. 4 provides an 'external' wind path, which means that wind or air flow is guided around the signal head 300.

The snow shield 350 is configured as tunnel visor with a lower cut-out and is mounted to a background support structure 380, wherein the background support structure 380 is fixed to the signal housing 310. The signal housing 310 is mounted, for example bolted, to a mounting bracket 390 or type of structure for mounting the signal head 300 to a mast or post. Typically, the signal head 300 is secured onto a pipe or another bracket, which is on a signal bridge, a signal cantilever, or a signal mast. As noted, both the snow shield 350 and the background support structure 380 block surrounding light, e. g. sunlight, from sides and back of the signal head 300, so that the generated colored lights are well visible and can be seen from a far distance.

In an example, transparent wind guide 360 is attached to the snow shield 350 and covers the plurality of lights 320*a*, 320*b*, 320*c*. The transparent wind guide 360 comprises a curved surface. Alternatively, the wind guide 360 may comprise a flat surface. Adding the transparent wind guide 360 onto the snow shield 350 prevents air from traveling into the snow shield 350, i. e. into the snow shield covered area towards the lights 320*a*, 320*b*, 320*c*, and guides the air to sides of the snow shield 350.

Further, the signal head 300 comprises front side wind guides 370. Although FIG. 3 shows only one front side wind guide 370, it should be noted that the signal head 300 comprises two front side wind guides 370 arranged on opposite sides of the snow shield 350. Each side wind guide 370 is mounted to the snow shield 350 via wind guide mounting elements 372. The side wind guides 370 may further be mounted to the background support structure 380.

Adding the front side wind guides 370 at sides of the snow shield 350 guides a portion of wind flow away from the signal head 300; otherwise, the wind flow would hit the flat background support structure 380. Further, the front side wind guides 370 reduce vacuum caused by air circulating around sharp edges of the background support structure 380. In another example, the front side wind guides 370 may be curved for further wind load reduction.

FIG. 4 illustrates a perspective angled rear view of the first embodiment, as illustrated for example in FIG. 3, in accordance with an exemplary embodiment of the present disclosure.

In an exemplary embodiment, the front side wind guide 370 is configured such that, when mounted, it creates a vertical through-opening 374 between the wind guide 370 and the snow shield 350. For example, the front side wind guide 370 is a flat piece of material, for example metal or plastics, that is mounted on one side to the snow shield 350, via elements 372, and on the other, opposite side to the background support structure 380, thereby creating an open space (through-opening 374) between snow shield 350, front side wind guide 370 and background support structure 380.

In another exemplary embodiment of the present disclosure, the signal with signal head 300 comprises one or more rear wind guides 400. A rear wind guide 400 is located and mounted on a back side of the background support structure 380, i. e. behind the background support structure 380 when viewing the signal head 300 from a front side. The rear wind guides 400 are arranged on opposite sides of the signal housing 310.

The rear wind guides 400 are configured such that they create a transition from the front side wind guide 370 to a back of the signal head 300, wherein a portion of wind flow is guided away from the signal head 300. The rear wind guides 400 are positioned on each side of the housing 310 and are mounted to the backside of the background support structure 380 and/or to the housing 310. Generally, vertical dimensions of the rear wind guides 400 correspond to vertical dimensions of the front side wind guides 370, in order to create a continuous surface guiding wind flow away from the signal head 300. The rear wind guides 400 also reduce vacuum caused by air circulating around sharp edges of the background support structure 380. Similar to the front side wind guides 370, the rear wind guides 400 comprise a vertical through-opening 402 (open space) between the background support structure 380 and the rear wind guide 400.

In another embodiment, the rear wind guide(s) 400 may be configured such that the rear wind guide(s) cover the signal housing 310. In this case, only one rear wind guide 400 may be necessary, reaching from one side of the background support structure 380, covering the housing 310, to the other side of the background support structure 380.

Figure 5:
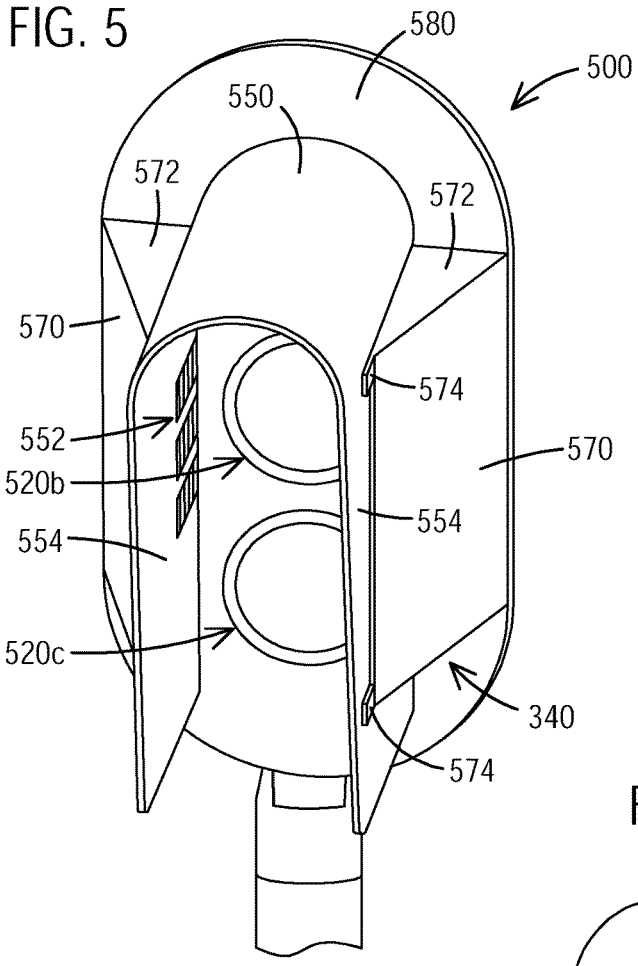
FIG. 5 illustrates a perspective angled front view of a second embodiment of a railroad signal in accordance with an exemplary embodiment of the present disclosure.

FIG. 5 illustrates a perspective angled front view of a second embodiment of a railroad signal in accordance with an exemplary embodiment of the present disclosure. The embodiment described with reference to FIGS. 5-7 describes embodiment(s) without a transparent front wind guide. A transparent front wind guide 360 is described for example in connection with FIG. 3 and FIG. 4.

In some cases, a transparent front wind guide may not be allowed or accepted, for example by railroad authorities. Thus, to eliminate or at least significantly reduce wind loads on the signal, signal head 500 comprises a protection device 340 with one or more components that create an 'internal' wind path. An internal wind path guides wind/air 'through' the signal head 500, for example from an inner area of snow shield 550 to a back of the signal head 500.

To create such an internal wind path, the snow shield 550 comprises multiple openings 552 on both of its side walls 554. The multiple openings 552 can be elongated slits that allow air to enter or exit. Of course, the openings 552 can have different shapes and/or sizes.

Further, the signal head 500 comprises enclosed front side wind guides 570, that are similar to the front wind guides 370 (see FIG. 3). A difference is that each front side wind guide 570 does not have a vertical through-opening but is enclosed via upper covers 572 and lower covers 574. Because the snow shield 550 comprises openings 552 within the snow shield 550, the side wind guides 570 are closed to block surrounding light that otherwise may enter and impact (worsen) visibility of the lights 520*a*, 520*b*, 520*c*. The enclosed wind guides 570 are mounted to the snow shield 550 via mounting elements 574 and/or to the background support structure 580.

Figure 6:
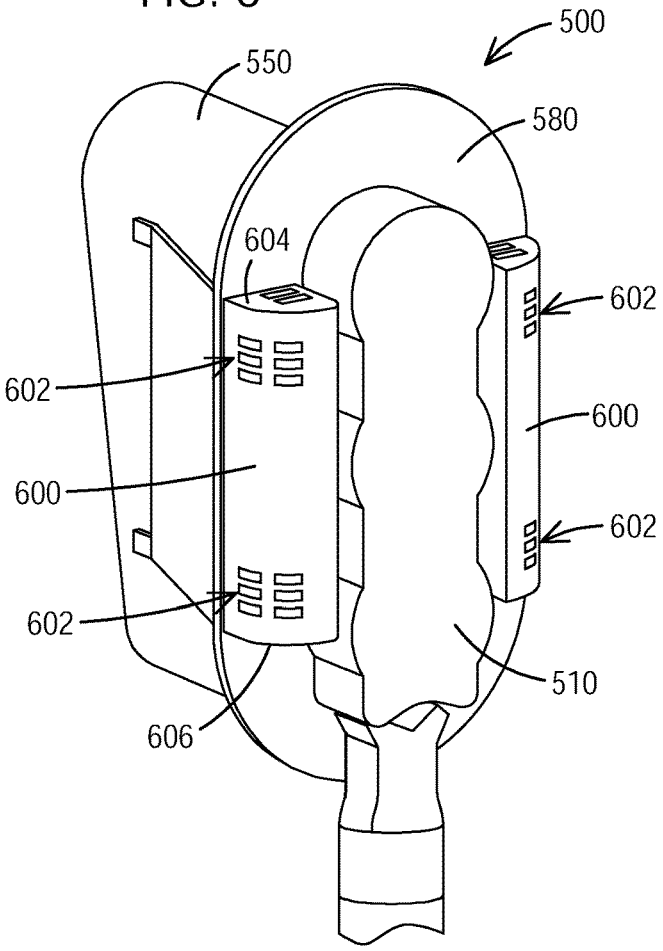
FIG. 6 illustrates a perspective angled rear view of the second embodiment of a railroad signal in accordance with an exemplary embodiment of the present disclosure.
Figure 7:
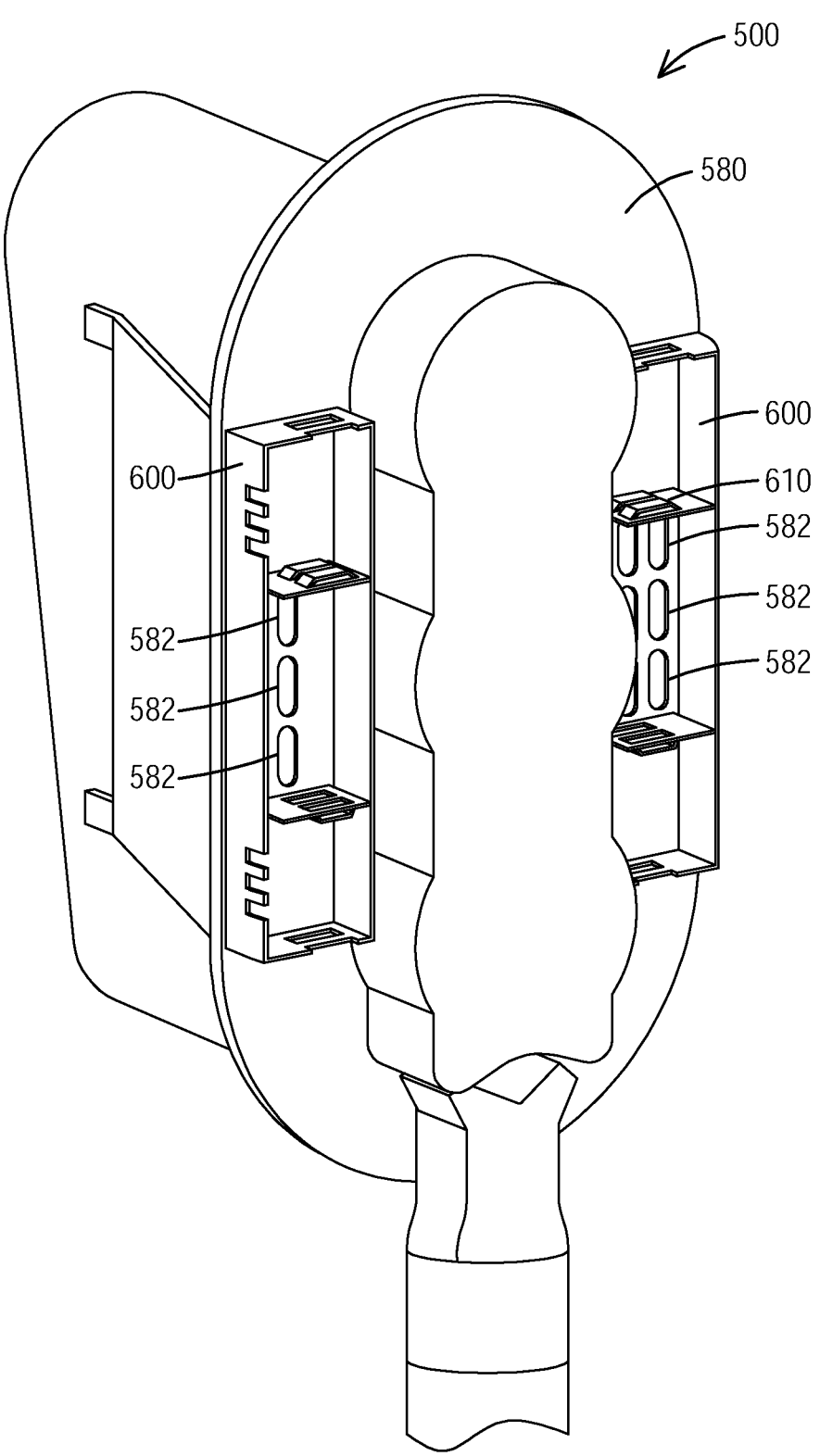
FIG. 7 illustrates a sectioned view of a perspective angled rear view of the second embodiment of a railroad signal in accordance with an exemplary embodiment of the present disclosure.

FIG. 6 illustrates a perspective angled rear view and FIG. 7 illustrates a sectioned view of the perspective angled rear view of the second embodiment of a railroad signal in accordance with an exemplary embodiment of the present disclosure.

As noted in connection with FIG. 5, the snow shield 550 comprises multiple openings 552. To create the internal wind path, an interior or inner space of the enclosed wind guides 570 is empty or hollow. Thus, air may flow through the openings 552 of the snow shield 550 and into the enclosed wind guides 570, or vice versa.

Further, in accordance with an exemplary embodiment, the background support structure 580 comprises openings or holes 582, as best seen in FIG. 7, to create the internal wind path. The multiple openings 582, for example elongated slits, may for example match in position and size with the openings 552 of the snow shield 550 to provide a continuous path for air flow. However, it should be noted that the openings 582 of the background support structure 580 may or may not align with the openings 552 of the snow shield 550.

Furthermore, the signal head 500 comprises enclosed rear wind guides 600 with openings/holes 602, wherein the air/wind can enter or exit via the openings 602. The rear wind guides 600 are enclosed via upper covers 604 and lower covers 606, with the exceptions of openings 602 in the upper and lower covers 604, 606, as well as other openings 602. The rear wind guides 600 are closed to block surrounding light that otherwise may enter the signal head 500. The enclosed rear wind guides 600 are mounted on a backside of the background support structure 580 and/or the housing 510.

As can be seen in FIG. 7, which provides a detailed sectioned view of the rear wind guides 600, the rear wind guides 600 may comprise one or more light reduction baffles 610 to block, or at least significantly reduce, surrounding light that may enter through the openings 602 and potentially impact visibility of the lights.

Figure 8:
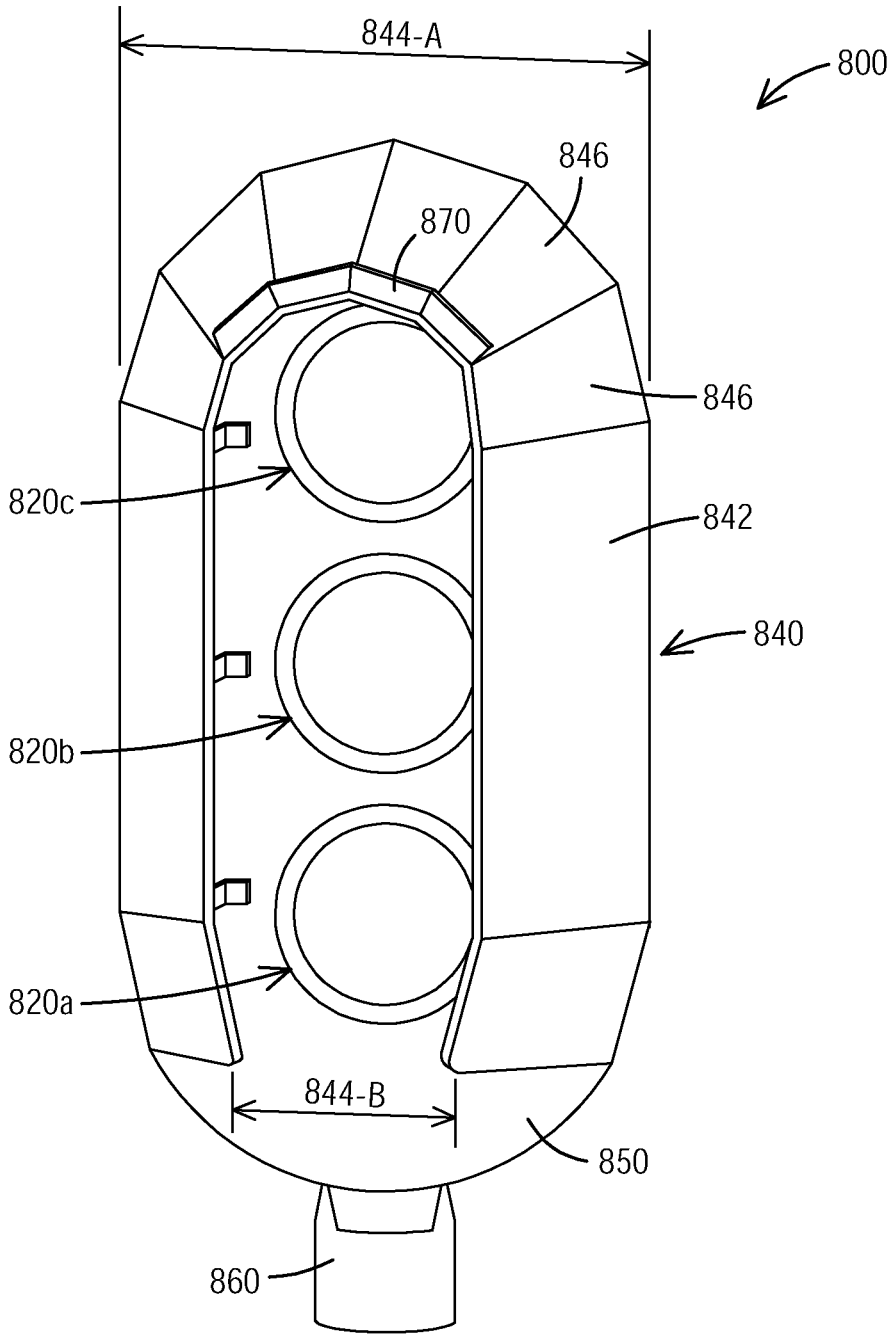
FIG. 8 illustrates a front view of a third embodiment of a railroad signal in accordance with an exemplary embodiment of the present disclosure.
Figure 9:
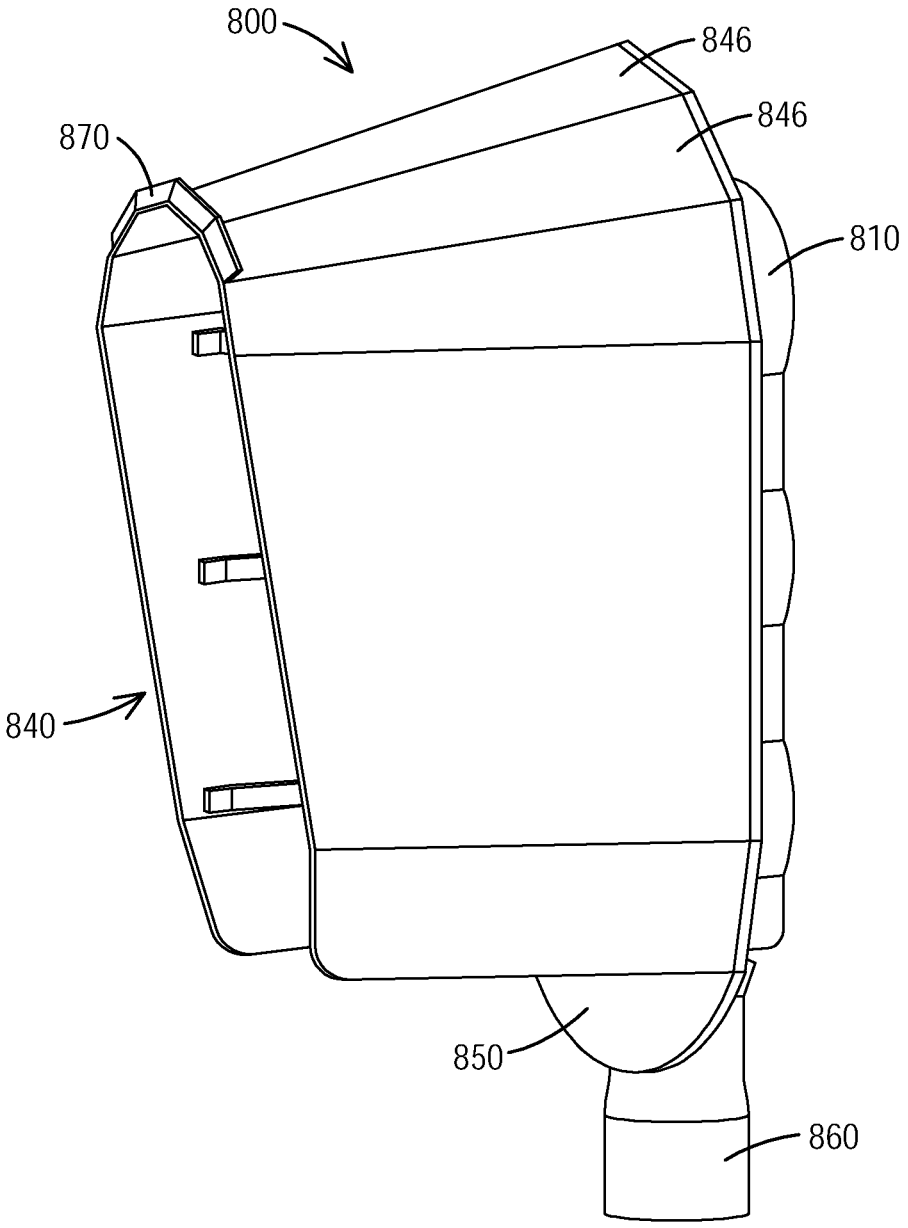
FIG. 9 illustrates a side view of the third embodiment of a railroad design in accordance with an exemplary embodiment of the present disclosure.

FIG. 8 illustrates a front view and FIG. 9 illustrates a side view of a third embodiment of a railroad signal in accordance with an exemplary embodiment of the present disclosure.

In accordance with a further exemplary embodiment, signal head 800 comprises a protection device 840, including snow shield feature(s) and wind guide feature(s). The protection device 840 incorporates snow shield features/functionalities and wind guide features/functionalities, such that the snow shield acts as a wind guide. The protection device 840, i. e. combined snow shield and wind guide, can be manufactured from one piece or multiple pieces. In an example, the protection device 840 can be manufactured from two identical halves.

Signal head 800 comprises a signal housing 810, a plurality of signal lights 820*a*, 820*b*, 820*c* positioned in the signal housing 810. The signal lights 820*a*, 820*b*, 820*c* can comprise LEDs and/or incandescent lighting. The signal housing 810 is mounted, for example bolted, to a mounting bracket 860 or type of structure for mounting the signal head 800 to a mast or post. Typically, the signal head 800 is secured onto a pipe or another bracket, which is on a signal bridge, a signal cantilever, or a signal mast.

The protection devices 840 is mounted to background support structure 850, wherein the background support structure 850 is fixed to the signal housing 810. The protection device 840 may be bolted, screwed, or welded to the background support structure 850. The protection device 840 may comprise metal, plastic or another type of composite material, or a combination thereof. However, it should be noted that the protection device 840 can comprise many other types of material(s) that a suitable to be used for the protection device 840.

In an embodiment, the protection device 840 is configured as tunnel visor with a lower cut-out, wherein the device 840 comprises a tapered tunnel body 842. Specifically, a width, illustrated schematically by arrows 844-A and 844-B, of the tapered body 842 reduces in a direction away from the background support structure 850. As shown in FIG. 8, the tapered body 842 comprises a greatest width 844-A where the body 842 is mounted to the background support structure 850. Then, the width reduces and the tapered body 842 comprises a smallest width 844-B opposite and furthest away from the greatest width (out of the drawing plane with respect to FIG. 8).

The tapered body 842 may comprise folding(s) 846 to provide the specific tunnel shape of the device 840. However, the body 842 may comprise a continuous smooth shape without folding(s).

In another embodiment, as can be best seen in FIG. 9, the protection device 840 comprises a rain and/or ice diverter 870. The diverter 870 is integrated into the protection device 840 or can be a separate component attached to the device 840. The rain and/or ice diverter 870 is positioned on an upper portion of the device 840, specifically on a front upper portion of the tapered body 842 so that the rain, ice or other type of precipitation can be diverted to improve visibility of the signal lights 820*a*, 820*b*, 820*c*.

Figure 10:
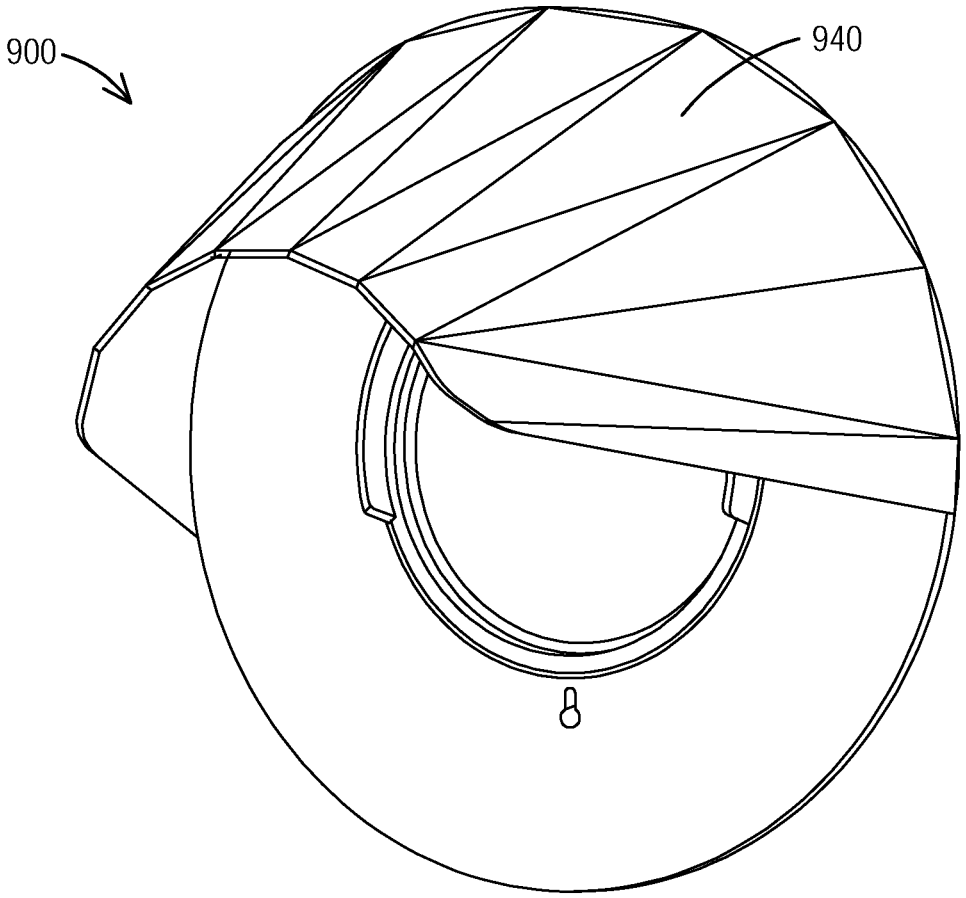
FIG. 10 illustrates a front view of a fourth embodiment of a railroad signal in accordance with an exemplary embodiment of the present disclosure.

FIG. 10 illustrates a front view of a fourth embodiment of a railroad signal in accordance with an exemplary embodiment of the present disclosure.

In accordance with a further exemplary embodiment of the present disclosure, signal head 900 comprises a protection device 940, including snow shield feature(s) and wind guide feature(s). The protection device 940 incorporates snow shield features/functionalities and wind guide features/functionalities, such that the snow shield acts as a wind guide. The protection device 940, i. e. combined snow shield and wind guide, can be manufactured from one piece or multiple pieces. The protection device 940 is similar to the protection device 840, illustrated in FIG. 8 and FIG. 9, and comprises the functionalities and characteristics as described for the device 840. The signal shown in FIG. 10 is a flashing light signal, which is a crossing signal used to warn vehicle traffic that a train is approaching or occupying a railroad grade crossing.

The present disclosure provides modified signal shapes including wind reduction elements to reduce or eliminate wind loads and thus reduce or eliminate damage either on the signal itself or on its support structure. In general, an improved light signal is achieved by creating external or internal air/wind paths. Such external or internal wind paths are created by adding either flat or curved parts to the signal head, for example a background support structure, or adding wind path(s) from the snow shield to the back of the signal or adding features to the snow shield to allow the air to exit or enter or using two or more layer background design(s) which allow air flow but block surrounding light from its backside. By adding wind reduction elements, wind force (wind drag) is considerably reduced by 10% to 40% for major concerned wind direction(s), according to for example an aerodynamic drag table.

While embodiments of the present disclosure have been disclosed in exemplary forms, it will be apparent to those skilled in the art that many modifications, additions, and deletions can be made therein without departing from the spirit and scope of the disclosure and its equivalents, as set forth in the following claims.

The invention claimed is:

1. A signal head comprising:
a signal housing,
a plurality of signal lights positioned in the signal housing, and
a protection device for reducing or eliminating wind forces, the protection device comprising
a snow shield, and
at least one wind guide element,
wherein the protection device incorporates the snow shield and the at least one wind guide element, such that the snow shield acts as a wind guide,
wherein the protection device comprises a tapered body and is configured as tunnel visor with a lower cutout, and
wherein the protection device is mounted to a background support structure, and wherein a width of the tapered body reduces in a direction away from the background support structure.

2. The signal head of claim 1,
wherein the protection device comprises a rain and/or ice diverter.

3. The railroad signal of claim 1,
wherein the protection device comprises metal, plastic, a type of composite material, or a combination thereof.

4. A signal comprising:
a mounting bracket, and
a signal head as claimed in claim 1, the signal head being mounted to another structure by the mounting bracket.

5. A signal head comprising:
a signal housing,
a plurality of signal lights positioned in the signal housing, and
a protection device for reducing or eliminating wind forces, the protection device comprising
a snow shield, and
at least one wind guide element,
wherein the snow shield is configured as tunnel visor with a lower cutout,
wherein the snow shield is mounted to a background support structure,
wherein the at least one wind guide element comprises a rear wind guide located on a back side of the background support structure, and
wherein the rear wind guide creates an open space between the background support structure and the rear wind guide.

6. The signal head of claim 5,
wherein the snow shield comprises multiple openings on side surfaces allowing air to enter or exit.

7. The signal head of claim 6,
wherein the background support structure comprises multiple openings, wherein the multiple openings of the snow shield and the multiple openings of the background support structure are aligned.

8. The signal head of claim 5,
wherein the rear wind guide comprises upper and lower covers.

9. The signal head of claim 8,
wherein the rear wind guide comprises multiple openings allowing air to enter or exit.

10. The signal head of claim 8,
wherein the rear wind guide comprises light reduction baffles positioned within an interior of the rear wind guide and configured to block surrounding light.

11. A signal head comprising:
a signal housing,
a plurality of signal lights positioned in the signal housing, and
a protection device for reducing or eliminating wind forces, the protection device comprising
a snow shield, and
at least one wind guide element,
wherein the snow shield is configured as tunnel visor with a lower cutout, wherein the snow shield is mounted to a background support structure wherein the at least one wind guide element comprises a front side wind guide mounted to the snow shield, and wherein the front side wind guide comprises upper and lower covers thereby creating an enclosed front side wind guide.

* * * * *